United States Patent [19]

Hufford

[11] 3,961,302

[45] June 1, 1976

[54] VARIABLE RESISTANCE CONTROL

[75] Inventor: James N. Hufford, Elkhart, Ind.

[73] Assignee: CTS Corporation, Elkhart, Ind.

[22] Filed: Nov. 15, 1974

[21] Appl. No.: 524,089

[52] U.S. Cl. ..... 338/174; 338/48; 338/137; 338/163

[51] Int. Cl.[2] ..... H01C 10/34

[58] Field of Search ..... 338/48, 128, 137, 162, 338/163, 167, 174, 175

[56] References Cited

UNITED STATES PATENTS

| | | | |
|---|---|---|---|
| 2,678,985 | 5/1954 | Smith, Jr. | 338/137 X |
| 2,883,499 | 4/1959 | Kilby et al. | 338/137 |
| 3,015,793 | 1/1962 | Fraser et al. | 338/162 |
| 3,362,003 | 1/1968 | Beitner et al. | 338/174 |
| 3,585,559 | 6/1971 | Rosema et al. | 338/174 X |
| 3,855,564 | 12/1972 | Dumas | 338/174 X |

*Primary Examiner*—Volodymyr Y. Mayewsky

[57] ABSTRACT

A variable resistance control employs a substrate provided with a center aperture and a plurality of corner and intermediate locator means disposed about the periphery of the substrate. An adjusting; means constraining a contactor to rotate therewith is journaled in the aperture and the contactor wipingly engages a film type resistive path disposed on the surface of the subsrate. A first plurality of terminal members are disposed in the corner locator means of the substrate a first distance from the aperture. A second plurality of terminal members are disposed in a predetermined number of said intermediate locator means a second distance from the aperture at a distance closer than said first distance. At least one of the terminal members disposed in said intermediate locator means is in an interference path with a projection extending from the adjusting means to arrest rotation of the adjusting means.

9 Claims, 4 Drawing Figures

VARIABLE RESISTANCE CONTROL

This invention relates generally to electrical controls, and more particularly, to variable resistance controls.

Modern day electronic applications often require variable resistors wherein the variable resistor substrate provides a variety of terminal configurations and interconnected resistive paths. Such a variable resistor is shown in U.S. Pat. No. 2,883,499. However, in many variable resistor applications it is often desirable to provide different ranges of rotation of the rotatable element. That is, a variable resistance control should provide the means to stop the rotatable element at various locations on the substrate. Various means are available to halt the rotation of a variable resistance control such as the knob of the control abutting the substrate or housing or abutting a member projecting from the substrate or housing. However, there is usually very little flexibility in changing the location with respect to the housing or substrate where the rotatable member is halted without altering the configuration of the knob or housing. It would therefore be desirable to provide a variable resistance control that provides a high degree of flexibility and simplicity in arresting the rotation of the rotatable element with respect to the substrate of the variable resistance control.

Accordingly, it is an object of the present invention to provide a new and improved variable resistance control. Another object of the present invention is to provide a variable resistance control comprising a substrate with the means to halt the rotating element at a variety of locations along the substrate. Still another object of the present invention is to provide a new and improved variable resistance control wherein a substrate provides the means to locate terminal members in predetermined locations in an interference path with the rotatable element.

Further objects and advantages of the present invention will become apparent as the following description proceeds and the features of novelty characterizing the invention will be pointed out with particularity in the claims annexed to and forming a part of this specification.

Briefly, the present invention is concerned with a ceramic substrate provided with a center aperture and a plurality of corner and intermediate locator means disposed around the periphery. The substrate supports a contactor driver having a shaft projecting through the aperture and a film type resistive path is disposed on a first surface of the substrate about the outer aperture. A contactor constrained to rotate with the contactor driver wipingly engages the resistive path. Terminal members extending through the corner locator means are disposed a first distance from the center aperture and the terminal members extending through the intermediate locator means are disposed a second distance from the center aperture closer than said first distance. The terminal members comprise an engagement portion extending above the first surface of the substrate. A projection integral with the contactor driver rotates in an interference path with respect to the terminal members extending through the intermediate locator means and abuts predetermined ones of said engagement portions to arrest rotation of the driver. Film type resistive paths can be provided to interconnect predetermined ones of said terminal members.

For a better understanding of the present invention, reference may be had to the accompanying drawings wherein the same reference numerals have been applied to like parts and wherein.

Figure 1:
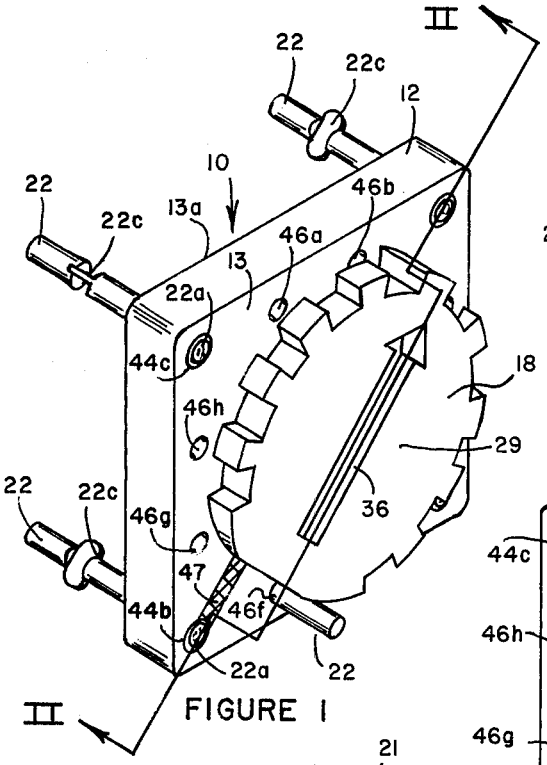
FIG. 1 is an isometric view of a variable resistor built in accord with the present invention.
Figure 2:
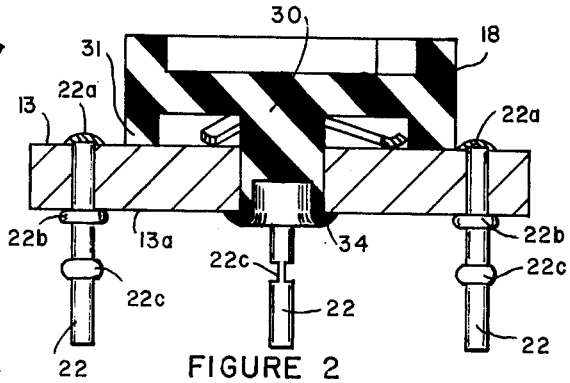
FIG. 2 is a sectional view taken along line II—II of FIG. 1.
Figure 3:
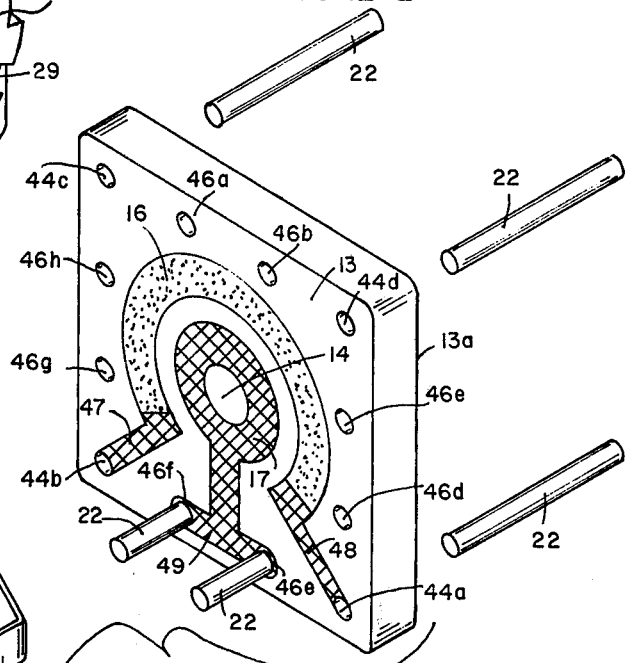
FIG. 3 is an exploded isometric view of the variable resistor of FIG. 1 with partially assembled terminals.

Referring now to FIGS. 1–3, there is illustrated a variable resistance control generally indicated by the numeral 10 comprising a square shaped substrate 12 with planer surfaces 13 and 13a and formed of a ceramic material such as alumina. The substrate 12 is provided with a center aperture 14 and supports resistance means in the form of an arcuate resistive film or path 16, a conductive collector 17, a thermoplastic knob 18 rotatably secured to the substrate 12, and a plurality of terminals 22. A contactor 20 with contacts 21 and 21a is constrained to rotate with the knob 18 for wipingly engaging the resistive path 16. Preferably, the resistive path 16 is formed of a suitable cermet resistive material such as disclosed in the Faber et al. U.S. Pat. No. 3,304,199 and the conductive collector 17 comprises a film of palladium-gold or other suitable conductive material. Preferably, the conductive collector 17 is coated with a non-solderable film for preventing adherence of solder to the conductive collector during the assembly process.

The knob 18 comprises a surface 28 with a shaft 30 and an annular skirt 31 depending therefrom, the skirt having an edge 41. The surface 28 is provided with openings 32 disposed on opposite sides of the shaft 30 intermediate the shaft and the skirt 31. The shaft 30 is inserted in the center aperture 14 and an end portion 34 of the shaft 30 as best seen in FIG. 2 is heat swaged against surface **13*a* of the substrate 12 to rotatably secure the knob 18 to the substrate 12. A surface 29 of the knob 18 is provided with a slot 36 for insertion of a tool for adjustment of the knob, the slot 36 also providing visual indication of the location of contactor 20. A plurality of undulations 38 are disposed about the periphery of the knob 18 to facilitate rotation of the knob 18 by hand and a projection 40 on one of the undulations 38 extends to the edge 41 of the skirt 31 to provide a suitable stop member. The contactor 20 is trapped and resiliently compressed between the planer surface 13 of the substrate 12 and the surface 28 of the knob 18. The contactor is constrained to rotate with the knob 18 because of the engagement of a pair of ears 42 on the contactor 20 with the openings 32 in the knob 18. Upon rotation of the knob 18, the contact 21 wipingly engages the resistive path 16 and the contact 21*a* engages the collector 17**.

Figure 4:
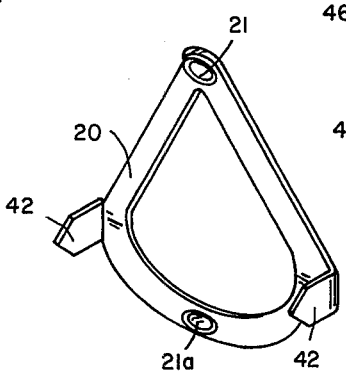
FIG. 4 is an isometric view of another embodiment of the invention.
Figure 4:
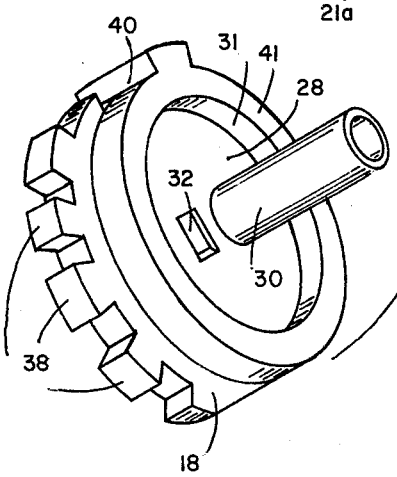
Figure 4:
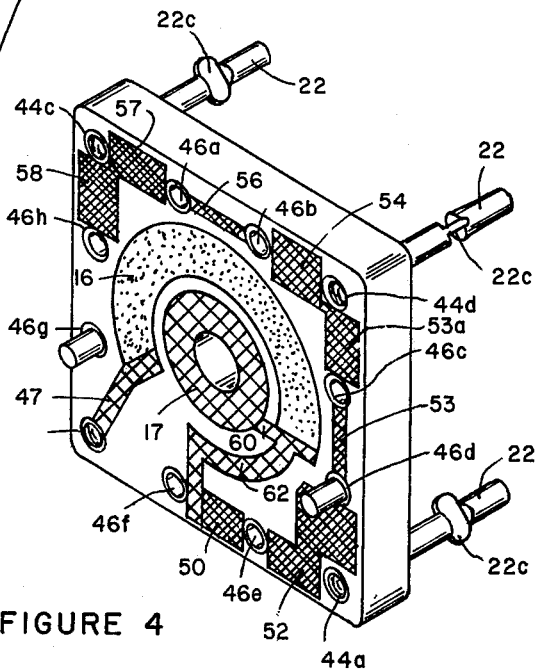

In accord with the present invention, the substrate 12 is provided with a plurality of corner holes or locator means **44*a*–44*d* and a plurality of intermediate holes or locator means 46*a*–46*h*, as best seen in FIGS. 3 and 4. The corner holes 44*a*–44*d* disposed around the periphery of the substrate are disposed a first distance from the center aperture 14 and the intermediate holes 46*a*–46*h* are disposed a second distance from the center aperture 14 closer than the distance of the corner holes from the center aperture. A pair of intermediate holes are disposed along each side of the substrate 12 between two corner holes and each of the corner and intermediate holes is equidistant from the next adjacent hole. Preferably, terminals 22 are disposed in the corner holes 44***a*–44*d* and in a predetermined number of the intermediate holes 46*a*–46*h*. Preferably, the terminals 22 comprise a head or engagement portion 22*a* abutting surface 13 of the substrate 12 and a second portion 22*b* abutting surface 13*a* of the substrate to secure the terminal to the substrate as best seen in FIG. 2. The head portion 22*a* of each of the terminals 22 is covered with a not shown solder coating and stand-offs 22*c* are provided with terminals 22 disposed in the corner holes to locate the substrate 12 with respect to a not shown PC board. It should be understood however that a terminal need not be disposed in each of the corner holes 44*a*–44*d* and that terminals 22 could be inserted from the opposite side of substrate 12 to provide an alternate mounting. For example, terminals could be inserted only in corner holes 44*a* and 44*b* and intermediate holes 46*e* and 46*f* along one edge of substrate 12 with engagement portions 22*a* abutting surface 13*a* and the terminals 22 bent parallel to surface 13 providing a stand-up mounting. A conductive path 47 interconnects one end of resistive path 16 with the terminal disposed in corner hole 44*b* and conductive path 48 interconnects the other end of resistance path 16 with the terminal disposed in corner hole 44*a*. Similarly, a conductive path 49 connected to conductive collector 17 interconnects the terminals disposed in intermediate holes 46*e* and 46*f*. It should be understood however that various other interconnections of terminals and resistive paths can be provided.

In accord with the present invention, the projection 40 on the knob 18 is rotated in an interference path with the terminals 22 disposed in the intermediate holes. As shown in FIGS. 1 and 3 terminals are disposed in intermediate holes 46*e* and 46*f*. Rotation of the knob 18 in the clockwise direction engages projection 40 with head portion 22*a* of the terminal 22 in hole 46e and rotation in the counterclockwise direction engages projection 40 with head portion 22*a* of the terminal 22 in hole 46*f*. It should be understood that the extension of terminals 22 through holes 46*e* and 46*f* in FIGS. 1 and 3 is exaggerated for illustration only and that the true relationship of the terminals 22 with respect to the substrate 12 is shown in FIG. 2 wherein engagement portions 22*a* extend above surface 13. It can be seen therefore that by merely placing terminals 22 in different intermediate holes 46*a*–46*h* the degree of travel of the contactor 20 along the substrate 12 can be varied. For example, with terminals 22 disposed in intermediate holes 46*e* and 46*f* there is approximately a 300° angle of rotation of the projection 40 between holes 46*e* and 46*f*. By placing terminals in the intermediate holes 46*d* and 46*g* as seen in FIG. 4, there is approximately a 195° angle of rotation of the projection 40 between the holes 46*g* and 46*d* assuming the width of projection 40 remains the same. Thus there is the flexibility in altering the range of rotation of the knob 18 as well as altering the location on the substrate wherein the rotation of the knob is arrested. It should be understood also that the projection 40 could be eliminated from the knob permitting a complete 360° angle of rotation of the knob around the surface of the substrate 12.

Various network configurations can be provided on surfaces 13 and 13*a* of the substrate 12. For example, as seen in FIG. 4, resistive paths 50, 52, 53, 53*a*, 54, 56, 57 and 58 along the periphery of the substrate 12 interconnect terminals disposed in holes 46*f*, 46*e*, 46*d*, 46*c*, 44*d*, 46*b*, 46*a*, 44*c* and 46*h* respectively. A conductive path 60 connects the collector 17 with one end of the resistive path 16 and conductive path 62 connects the end of the resistive path 16 to the terminal disposed in hole 46*f*. It should be understood that the ends of the resistive paths 50, 52, 53, 53*a*, 54, 56, 57 and 58 are electrically connected to respective terminals 22 through suitable not shown conductive terminations and that various resistive paths can also interconnect various terminals on the underside or surface 13*a* of the substrate 12 and these resistive paths can be connected to the resistive paths on surface 13 of the substrate 12 by means of the terminals 22.

From the foregoing, it is obvious that the variable resistance control of the present invention can be readily assembled in production. A substrate 12 is provided with a center aperture 14 and a plurality of peripheral holes and a center collector and suitable conductives are screened thereon. Suitable resistive paths are then screened on the substrate including a non-solderable film on the conductive collector. It should be appreciated that by screening a non-solderable film on the collector, it is possible to submerge the entire substrate in a solder bath without solder adhering to the collector. Terminals 22 are then inserted into the corner holes and predetermined intermediate holes. The entire substrate is then submerged in a solder bath to provide a suitable amount of solder at each terminal connection and along the length of each terminals to insure a solderable terminal. A knob 18 with contactor secured thereto is attached to the substrate by inserting the shaft 30 within the aperture 14 and heat swaging and enlarging a portion of the end of the shaft against the underside of the substrate.

While there has been illustrated and described what is at present considered to be two preferred embodiments of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent of the United States is:

1. In a variable resistance control, the combination of an electrically nonconductive substrate provided with an aperture and a plurality of sets of locator means disposed around the periphery of the substrate, each of said locator means in the set being equidistant from the next closest locator means in the set, the first set of said locator means being disposed in the corners of the substrate a first distance from said aperture, the remainder set of said locator means being symmetrically disposed about the aperture a second distance from said aperture, said first distance being greater than said second distance, resistance means supported on a first surface of the substrate, an electrically conductive collector carried on said first surface of the substrate, adjusting means rotatably secured to the substrate, a projection connected to the adjusting means and extending radially outwardly from the adjusting means, an electrically conductive contactor constrained to move with the adjusting means and wipably engaging the resistance means and the collector, the contactor being electrically insulated from the adjusting means, a plurality of terminal members disposed in a predetermined number of said first set of locator means and in a predetermined number of said remainder set of said locator means, the terminal members being electrically connected to the resistance means and to the collector, said terminal members electrically connecting the variable resistance control to an external circuit, the terminal member disposed in the remainder set of said locator means being in an interference path with said projection and comprising an engagement portion extending above said first surface.

2. The variable resistance control of claim 1, wherein said collector is in electrical engagement with a pair of terminal members disposed in said remainder of said locator means, one of said pair engaging said projection to halt rotation of the adjusting means in a first direction, the other of said pair engaging said projection to halt rotation of the adjusting means in a second direction.

3. A variable resistance control comprising an electrically nonconductive substrate having a flat surface and provided with a plurality of apertures, certain of the apertures being disposed along the periphery of the substrate and one of the apertures being disposed centrally of the substrate, resistance means supported on the flat surface of the substrate, an electrically conductive collector supported on the flat surface of the substrate adjacent to the resistance means, adjusting means rotatably secured to the substrate, an electrically conductive contactor constrained to move with the adjusting means wipably engaging the resistance means and the collector, the contactor being electrically insulated from the adjusting means, a first plurality of terminal members secured in the apertures disposed along the periphery of the substrate and electrically connected to the ends of the resistance means, a second terminal member secured in one of the apertures disposed along the periphery of said substrate at a distance closure to said aperture disposed centrally than the distance of said first plurality of terminal members from said aperture disposed centrally, the second terminal member being electrically connected to the collector, and a projection integral with and extending radially outwardly from the adjusting means, the projection being engageable with the second terminal member for limiting rotation of the adjusting means, said first plurality and second terminal members connecting the variable resistance control to an external circuit.

4. The variable resistance control of claim 3, wherein a third terminal is secured in another of the apertures disposed along the periphery of said substrate, said second and third terminal members being equidistant from the aperture disposed centrally, said projection abutting said second and third terminal members to halt rotation of the adjusting means in either direction.

5. The variable resistance control of claim 3, wherein said substrate is square shaped and said aperture is equidistant from the corners, said plurality of first terminal members being disposed at the corners of said substrate.

6. The variable resistance control of claim 3, wherein each of said second plurality of terminal members comprises an engagement portion extending above said substrate in an interference path with said adjusting means.

7. In a variable resistance control, the combination of an electrically nonconductive substrate provided with an aperture and a plurality of locator means disposed along the periphery of the substrate, a first set of the locator means disposed a first distance from the aperture of the substrate, the remainder of the locator means being disposed equidistant from said aperture at a distance closer to said aperture than said first set, a resistive path supported on the substrate, an electrically conductive collector supported on the substrate, an adjusting means rotatably secured to the substrate, an electrically conductive contactor constrained to move with the adjusting means and wipably engaging the resistive path and the collector, the contactor being electrically insulated from the adjusting means, a plurality of terminal members disposed in said locator means and electrically connected to the resistive path, and a projection integral with the adjusting means and extending radially outwardly from the aperture a distance greater than the distance from the aperture to the remainder of the locator means, the projection being engageable with the terminal member in the remainder of the locator means for limiting rotation of the adjusting means, the terminal members connecting the variable resistance control to an external circuit.

8. The variable resistance control of claim 7, wherein each of said locator means is equidistant from the next closest locator means.

9. The variable resistance control of claim 7, wherein a terminal member is disposed in each of said first set of locator means and a terminal member is disposed in at least two of said remainder of the locator means.

* * * * *